US005179745A

United States Patent [19]

Hebert et al.

[11] Patent Number: 5,179,745

[45] Date of Patent: Jan. 19, 1993

[54] ELEVATING CONVERTIBLE WHEELCHAIR

[76] Inventors: Neil H. Hebert; Debra M. Hebert, both of Rt. 1, Box 73X, Mitchell La., Des Allemands, La. 70030

[21] Appl. No.: 681,606

[22] Filed: Apr. 8, 1991

[51] Int. Cl.[5] ..... A47C 13/00

[52] U.S. Cl. ..... 5/620; 5/81.1; 5/86.1; 5/425

[58] Field of Search ..... 5/81 R, 81 B, 86, 63, 5/425, 72, 77, 81.1, 86.1, 620, 600; 297/DIG. 4; 269/325

[56] References Cited

U.S. PATENT DOCUMENTS

| | | | |
|---|---|---|---|
| 1,984,311 | 12/1934 | Lamar et al. | 297/DIG. 4 |
| 2,322,683 | 6/1943 | Costa et al. | 269/325 |
| 2,587,068 | 2/1952 | Sanders | 5/81 R |
| 2,609,862 | 9/1952 | Pratt | 297/DIG. 4 |
| 2,682,913 | 7/1954 | Scheide | 269/325 |
| 2,849,051 | 8/1958 | Streeter, III | 5/81 R |
| 2,869,614 | 1/1959 | Wamsley | 5/81 R |
| 3,038,174 | 6/1962 | Brown et al. | 5/68 |
| 3,284,126 | 11/1966 | Piazza | 5/67 |
| 3,495,869 | 2/1970 | Ingemansson | 5/81 R |
| 3,593,351 | 7/1971 | Dove | 5/81 R |
| 3,618,968 | 11/1971 | Greer | 297/DIG. 4 |
| 3,792,500 | 2/1974 | Swara, Sr. | 5/81 B |
| 3,936,893 | 2/1976 | Anderson et al. | 5/81 R |
| 4,079,990 | 3/1978 | McMunn et al. | 5/81 R |
| 4,453,732 | 6/1984 | Assanah et al. | 297/DIG. 4 |

FOREIGN PATENT DOCUMENTS

| | | | |
|---|---|---|---|
| 3505234 | 8/1986 | Fed. Rep. of Germany | 297/DIG. 4 |
| 162830 | 2/1980 | Netherlands | 297/DIG. 4 |

*Primary Examiner*—Eric K. Nicholson
*Attorney, Agent, or Firm*—Keaty & Keaty

[57] ABSTRACT

The invention relates to an elevating convertible wheelchair which converts to a flat bed to facilitate movement of a patient from the converted flat bed to a regular patient bed. The backrest hingedly pivots in relation to the seat portion to move into a co-planar relationship with the seat and forms a flat bed. A detachable headrest is engaged with the upper part of the back support for extension, when required. A secondary backrest support hingedly attaches to a free end of the backrest and pivots downwardly to rest on the floor and support the free end of the backrest. An elevating mechanism carried by a lower frame of the wheelchair allows elevation of the seat portion to a desired level. A connecting panel attaches to a side of the converted wheelchair to close a space between the flat bed and the adjacent side of the regular patient bed.

28 Claims, 1 Drawing Sheet

ELEVATING CONVERTIBLE WHEELCHAIR

BACKGROUND OF INVENTION

This invention relates to the transportation and care of disabled people, and more specifically to a wheelchair which can be converted to a flat bed and elevated to a level substantially similar to a level of a patient bed, so that the patient can be easily moved from the wheelchair to the bed.

It has been a continuous problem for patients and their attendants to move a disabled person from a seated position in a wheelchair to a bed, especially for patients which have limited or nor use of some or all of their limbs. Such patients are unable to assist their attendants in lifting them from the wheelchairs and moving them.

The present invention contemplates provision of an elevating convertible wheelchair which is inexpensive to manufacture and easy to operate, and which can be successfully used in an environment, wherein complicated and expensive equipment is not available.

SUMMARY OF THE INVENTION

The present invention achieves its objects by provision of a convertible elevating wheelchair which converts from a wheelchair to a flat bed and which can be elevated to a level substantially similar to the level of a patient bed, so that a patient can be easily moved or rolled from the converted wheelchair onto the patient bed.

This main goal is achieved through the provision of a wheelchair which comprises a lower support frame means, which carries a plurality of supporting wheels rotationally attached to the lower frame. A plurality of telescoping leg means extend substantially perpendicularly vertically from the lower frame means in such a manner, that the lower end of the leg means are anchored to the lower frame, while the upper free ends of the leg means support and carry a seat frame means.

A backrest means hingedly attaches to the seat frame means and moves from a normally vertically oriented position in substantially perpendicular relationship to the seat frame means to a position substantially co-planar with a seat frame means. A secondary backrest support means, or drop leg which is carried by the distant side of the backrest means hinges between a folded position in general parallel relationship to the back rest means and a position perpendicular to the backrest means, when the back rest is moved into its second position. In that case the secondary backrest support means, or drop leg, rests on the floor, supporting the free, distant end of the backrest means.

An elevating means, such as a jacking mechanism is supported by the lower frame means and, in its turn, supports the seat frame means to elevate or to lower same, upon demand. A pair of removable hand rails are secured to the upper frame means and to the backrest means, said handle means being removable when the wheelchair needs to be converted to a flat bed.

A detachable connecting panel is removably secured to the wheelchair after the handles have been removed to facilitate movement of a patient from a flat bed to a regular bed, closing the space between the flat bed and the regular bed.

In an alternative embodiment the connecting panel means is hingedly attached to the seat frame means and moves to a horizontally oriented position, when necessary.

It is, therefore, an object of the present invention to provide an elevating convertible wheelchair which can be easily converted from the wheelchair to a flat bed.

It is another object of the present invention to provide a wheelchair, the seat portion of which can be elevated, upon demand, to bring it to a desired level and secured at that level to enable movement of the patient resting on the converted flat bed to a regular patient bed.

It is a further object of the present invention to provide a convertible wheelchair which has means for supporting a free end of the back rest when the wheelchair has been converted to a flat bed.

Still further object of the present invention is to provide a wheelchair, wherein the handles can be easily detached to remove a side obstruction when rolling of the patient from the flat bed to the regular patient bed.

It is a further object of the present invention to provide a connecting means between the converted wheelchair and a regular patient bed.

These and other objects of the present invention will be apparent to those skilled in the art from the following description of the preferred embodiment.

BRIEF DESCRIPTION OF THE DRAWINGS

Referring now to the drawings, wherein like parts are designated by like numerals, and wherein.

DETAILED DESCRIPTION OF THE PREFERRED EMBODIMENT

Figure 1:
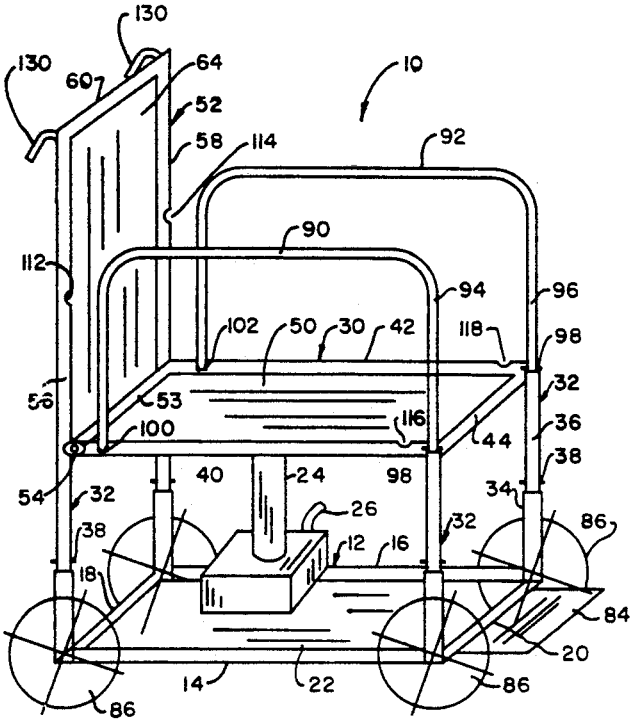
FIG. 1 is a perspective view of a convertible wheelchair in accordance with the present invention.
Figure 4:
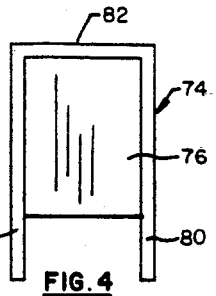
FIG. 4 is a front detail view of a removable headrest.

Referring now to the drawings in more detail, numeral 10 designates the wheelchair in accordance with the present invention. The wheelchair 10 comprises a lower support frame means 12 which is of a substantially rectangular configuration and which is formed by a pair of elongated braces 14 and 16 and a pair of transverse bars 18 and 20 attached to the braces 14 and 16 at their ends.

A lower frame support board 22 is fixedly attached within the periphery defined by the frame braces 14 and 16 and frame bars 18 and 20. Mounted on the board 22 is an elevating means 24 which is a jacking mechanism, such as a hydraulic, pneumatic, or electric elevating mechanism, which is activated by depression of a foot pedal, or any other suitable activating means 26 to elevate or lower a seat frame means 30. Since the jacking elevating means 24 can be of a different type or configuration, they are shown here only in a symbolic representation, which is well within the understanding of those skilled in the art.

Four leg means 32 are anchored at one of each of their ends to the frame means 12 and extend from the corners of the frame means 12 vertically upwardly, supporting by their free ends that seat frame means 30. Additional support, as was indicated above, is provided by the jacking mechanism 24 which interfaces the central portion of the underside of the seat frame means 30.

Each of the leg means 32 is telescopic leg which comprises a cylindrical or rectangularly-shaped tube 34 within which a smaller diameter or size upper leg portion 36 is telescopically engaged.

A transverse pin 38, or a similar stop means, is provided on the leg portions 36 of each leg means 32, so as to prevent unlimited movement of the leg portion 36 into the portion 34, when the seat means 30 is in its lowermost position.

The seat frame means 30 also has a generally rectangular configuration and is comprised of a pair of side braces 40 and 42 and a pair of transverse bars 44 and 46, which are attached to each other at their respective ends. A seat panel 50 stretches between the braces 40 and 42 and cross bars 44 and 46 to form the seat of the wheelchair 10.

Hingedly attached to the crossbar 46 is a back rest means 52 which is normally vertically oriented in generally perpendicular relationship to the seat 50. A release mechanism 54 releases a locking engagement between the crossbar 46 and a sleeve 53 of the backrest means 52, allowing the backrest means 52 to move into an unfolded position illustrated in FIG. 2 in such a manner that the backrest means 52 appears in a generally co-planar relationship with the seat means 30.

The backrest means 52 comprises a pair of elongated frame members 56 and 58, as well as a shorter cross bar 60 and the sleeve 53, which is hingedly circumferentially attached to the crossbar 46 of the seat means 30. Stretched between the frame members 56, 58, 60 and the sleeve 53 is a backrest panel 62 which serves as a back support for a patient sitting in the wheelchair 10.

The backrest panel 62 has a front surface 64 and a rear surface, against which a secondary backrest support means, or drop leg 66 folds, when the backrest means 52 is in its normally vertical orientation. The secondary back support means 66 comprises a pair of elongated bars 68 and 70 which are hingedly connected to the crossbar 60 at one of their ends and which carry a transverse bar 72 at their free ends.

Figure 2:
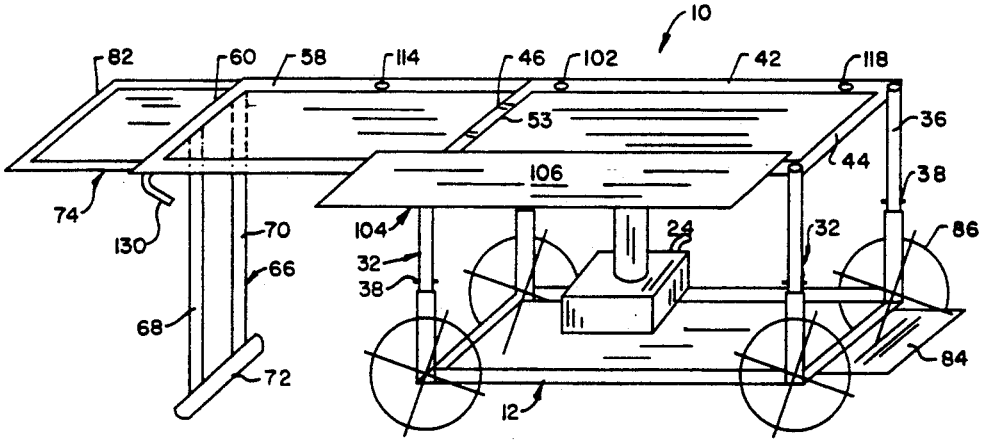
FIG. 2 is a perspective view of the convertible wheelchair of FIG. 1 after it has been converted to a flat bed and a connecting panel has been attached.
Figure 3:
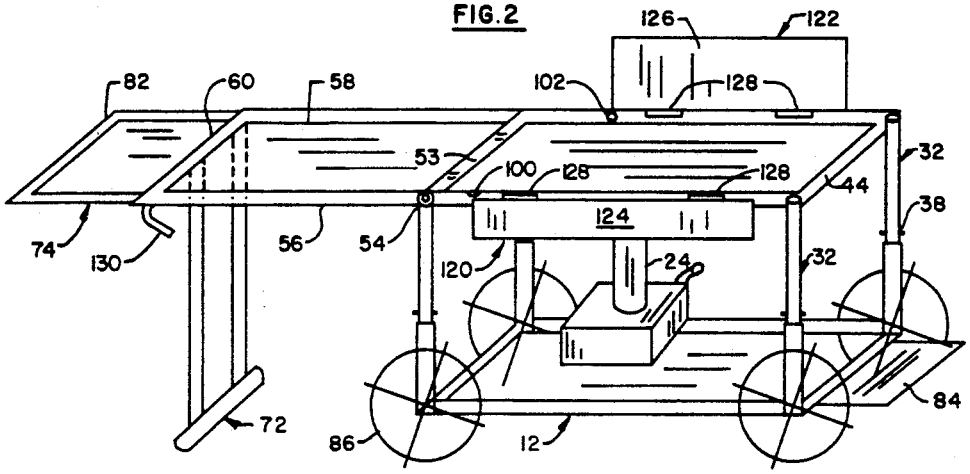
FIG. 3 is a perspective view of the flat bed, similar to FIG. 2, but using alternative panel connecting means.

The crossbar 72 is designed to rest on the floor when the wheelchair 10 is converted to a flat bed, as illustrated in FIGS. 2 and 3, by pivoting against an axis formed by the crossbar 60 and stopping when a specially formed stop means are contacted by the attaching ends of the bars 68 and 70. The means stopping or limiting the arc of rotation of the drop leg 66 can be in the form of U-shaped cut-out made in the outer surface of the crossbar 60, so that when the bars 68 and 70 contact the cut-out, they are prevented from continuous pivotal movement about the axis formed by the crossbar 60. Other suitable forms of rotation limiting means can be employed within the meaning of this invention.

The present invention further contemplates provision of a detachable and removable head rest support means 74 which can be attached to the back rest means 52 in a co-planar relationship to provide an additional support for the patient's head when the wheelchair 10 is converted to the flat bed. The head support means 74 comprises a pair of elongated rods or bars 78, 80 which telescopically engage by their lower portions within the tubes 56, 58 formed by the backrest means 52, while the headrest panel 76 can be formed from a flexible deformable material which stretches between the rod-type elements 78 and 80, as well as the transverse rod 82. When not in use, the head support means 74 can be stored on the frame member 22, or simply left in engagement with the backrest means 52.

A foot support 84 is provided for forming a support for patient's feet, the foot support 84 being fixedly attached to the crossbar 20 of the lower support frame means 12.

The wheelchair 10 is carried by a plurality of rotational wheels 86 which are rotationally mounted on axes formed by extensions of crossbars 18 and 20.

A pair of arm rests 90 and 92 is detachably secured to the wheelchair 10 by engaging forward ends, 94, 96 of the arm rests 90 and 92, respectively, in a telescopical fashion with the front leg portions 36. Cross pins 98, similarly to cross pins 38, prevent excessive movement of the handle 94 and 96 into the portions 36 of the front legs 32.

The U-shaped handles 90 and 92 have their distant ends 100 and 102 secured in a releasable fashion with the frame rail members 40 and 42 which are provided with suitably shaped and sized openings 100, 102. The openings 100, 102 are formed through the walls of the tubes forming the rail members 40, 42 through which the distant ends of the arm rests 90, 92 are inserted.

Other suitable means can be employed to secure the distant ends in a relatively stable position with the backrest means 52. The handles 90 and 92 can be removed from their position by first pulling upwardly their forward portions from engagement with leg portions 36 and then pulling outwardly distant ends from openings 100, 102 of the rails 40 and 42. It is not necessary to remove both handles 90 and 92 when transporting the patient from the converted wheelchair to the bed, but only remove one of the handles adjacent the side by which the wheelchair 10 contacts the patient's bed and allow rolling or moving of the patient from the flat bed to the regular bed.

The present invention further contemplates provision of a connecting panel means in order to close the space between a regular patient bed and the converted flat bed and facilitate movement or rolling of the patient from the flat bed to the regular bed.

It was observed that a narrow space is almost always left between the edge of the regular bed and the wheelchair. The attendant usually has to exert a substantial force trying to move an immobile patient across this gap. To solve this problem the present invention provides a connecting panel means which can be either detachably or hingedly connected to the wheelchair.

Figure 5:
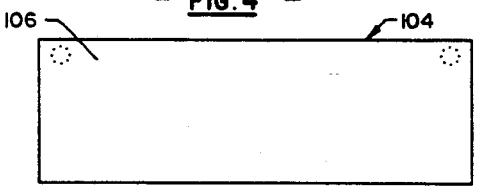
FIG. 5 is a top plan view of a connecting panel.
Figure 6:
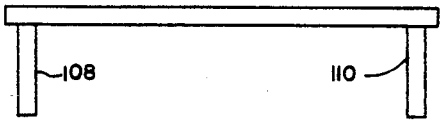
FIG. 6 is a side view of the panel of FIG. 5.

Referring first to the embodiment in FIG. 2, a detachable connecting panel means will be discussed. The panel means is designated by numeral 104 and is shown in detail in FIGS. 5 and 6. The connecting panel 104 comprises a flat panel 106 and a pair of engagement legs 108 and 110. Corresponding openings 112, 114, 116 and 118 are made in the backrest frame members 56, 58 and seat rail members 40, 42, respectively.

When the wheelchair 10 has been converted to a flat bed, as shown in FIG. 2, the connecting panel means is lowered to the flat bed, while aligning the leg 108 with opening 112 or 114 and the leg 110 with the opening 116 or 118, depending on the side of the flat bed which is positioned adjacent the edge of the regular bed. Once the underside of the panel 106 contacts the top of the frame rail members 56, or 58 and 40, or 42, the connecting panel means 104 becomes securely engaged with the flat bed and the patient can be easily moved.

Referring now to the embodiment of FIG. 3, a hingedly attached connecting panel means 120 and 122 is illustrated. Each connecting means 120, 122 comprises a panel 124, 126, respectively, which is attached by hinges 128 to its respective rail member 40 or 42. Normally, the panels 124, 126 are oriented vertically downwardly (as can be seen with the panel 124) "dropping" freely from the rails 40, 42. When in use, the panels 124 or 126 is lifted and locked in a horizontal orientation to close the gap between the flat bed and the regular bed. If desired, the panel on the opposite side of the bed can be lifted and locked vertically upwardly (as can be seen with panel 126 in FIG. 3). It can be done to form a protective barrier on the flat bed or for other purposes. A standard multiple position locking mechanism in a form of a tooth wheel can be employed. Other suitable means for locking the panel 124, 126 can be used, if desired.

The panels 106 can be made of different lengths depending on the needed support for torso, legs or just for torso. Then, position of the openings 112, 114 will be suitably adjusted.

The headrest panel 76 can be made from a non-deformable material, if needed.

The wheelchair 10 is conveniently provide with a pair of push handles 130 which are fixedly attached to the rear side of the backrest means 52.

In operation, when a patient seated in a wheelchair 10 needs to be moved to a regular patient bed, the attendant first removes one of the arm rests 90 or 92 from the engagement with the leg means 32 and the rail member 40 in any desired order. The release means 54 is then activated to allow pivotal movement of the backrest means 52 into a co-planar relationship with a seat frame means 30 and allow the patient to move from a seated position to a lying position. At the same time, the secondary backrest support means 66 moves in an arc towards the floor until it rests with its cross bar 72 on the floor at a level of the wheels 86. If desired, the headrest means 74 can be secured to the backrest support means 52 in the above described manner. The patient is, therefore, allowed to move from a seated position to a lying position on the converted flat bed of FIGS. 2 or 3.

The attendant then activates the elevating means 24, lifting the seat portion and thereby the backrest portion of the wheelchair 10 to a level substantially co-planar with the level of the regular patient's bed.

If the embodiment of the FIG. 2 is to be used, the attendant then secures the legs 108 and 110 with the openings in the frame members of the side of the wheelchair which is adjacent to the patient's bed. The panel 106 is made conveniently wide to not only close the gap between the wheelchair and the bed but also slightly overlap the bed, so as to move the patient closer to the center of the bed and away from the edge. The patient is then moved or rolled from the wheelchair 10 onto the bed.

If the embodiment of FIG. 3 is used, the panel 124 or 126, which is most adjacent to the side of the regular patient bed is pivotally moved about hinges 128 till it reaches a position coplanar with the seat panel 50. It is also preferred that the width of the panels 124 and 126 be made slightly greater than an expected gap between the wheelchair and the regular patient's bed.

Once locked in a horizontal orientation, the panel 124 or 126 serves as a connecting means between the wheelchair and the bed, allowing easy movement of the rolling of the patient from the wheelchair 10 to the patient bed and away from the edge of the bed.

Many other modifications and changes can be made within the design of the present invention without departing from the spirit thereof. We, therefore, pray that our rights to the present invention be limited only by the scope of the appended claims.

We claim:

1. An elevating convertible wheelchair, comprising:

a lower support frame means carrying a plurality of rotating wheels attached thereto;

a plurality of telescoping leg means fixedly anchored at their lower ends to the lower support frame means and extending vertically therefrom;

a seat frame means carried by upper ends of the leg means;

a backrest means hingedly attached to the seat frame means and moveable from a first, normally vertically oriented position in perpendicular relationship to the seat frame means to a second position, substantially co-planar with said seat frame means;

a secondary backrest support means hingedly attached to a free end of said backrest means and moveable between a normally co-planar position with said backrest means to a position substantially perpendicular to said backrest means, so as to support the free end of the backrest means when the wheelchair is converted to a flat bed;

a means for elevating the seat frame means to a desired level, said elevating means being carried by the lower frame means;

a connecting panel means secured to at least one side of the wheelchair for covering a space between the converted flat bed and an adjacent side of a regular patient bed; and a detachable arm rest means removably engageable with at least one of said leg means.

2. The apparatus of claim 1, wherein the arm rest means comprises a pair of U-shaped handles, each having a forward end and a distant end, and wherein said forward end is telescopically detachably engaged with at least one of said leg means.

3. The apparatus of claim 2, wherein said seat frame means comprises a pair of elongated parallel tubular rail members, and wherein each of said tubular rail members is provided with an opening which receives the distant end of one of the handles therethrough.

4. The apparatus of claim 1, wherein said elevating means comprises a foot pedal for activating said elevating means.

5. The apparatus of claim 1, wherein each of said leg means comprises a lower portion which engages the lower frame means and an upper portion which is telescopically received in the lower portion.

6. The apparatus of claim 5, wherein each of said leg means is provided with a means for limiting telescopical movement.

7. The apparatus of claim 6, wherein said limiting means comprises a transverse pin which is secured to the upper leg portion in transverse relationship to a longitudinal axis of the upper leg portion.

8. An elevating convertible wheelchair, comprising:

a lower support frame means carrying a plurality of rotating wheels attached thereto;

a plurality of telescoping leg means fixedly anchored at the their lower ends to the lower support frame means and extending vertically therefrom;

a seat frame means carried by upper ends of the leg means;

a backrest means hingedly attached to the seat frame means and moveable from a first, normally vertically oriented position in perpendicular relationship to the seat frame means to a second position, substantially co-planar with said seat frame means, said backrest means comprising an upper cross bar attached at its ends to a pair of parallel elongated tubular members;

a secondary backrest support means hingedly attached to a free end of said backrest means and moveable between a normally co-planar position with said backrest means to a position substantially perpendicular to said backrest means, so as to support the free end of the backrest means when the wheelchair is converted to a flat bed;

a means for elevating the seat frame means to a desired level, said elevating means being carried by the lower frame means;

a connecting panel means secured to at least one side of the wheelchair for covering a space between the converted flat bed and an adjacent side of a regular patient bed; and a detachable headrest means adapted to be engaged with the backrest means, and wherein said headrest means comprises a pair of elongated rod members, a portion of each of which is telescopically retractably received in a corresponding rail member of the backrest means.

9. The apparatus of claim 8, wherein said headrest means further comprises a headrest panel stretched between the elongated rods and a transverse bar.

10. The apparatus of claim 1, further comprising a release means for releasing a locked position of the backrest means and allowing rotation of the backrest means into the second position.

11. The apparatus of claim 1, wherein said connecting panel means comprises a panel and a pair of engagement legs perpendicularly attached to an underside of the panel.

12. The apparatus of claim 11, wherein said seat frame means comprises a pair of parallel elongated rail members, and said backrest frame means comprises a pari of elongated parallel frame tubes, and wherein openings are formed in said rail members an said frame tubes, said openings being sized and shaped to receive free ends of the panel engagement legs therein.

13. The apparatus of claim 1, wherein said connecting panel means comprises a pair of panels, each of which is hingedly attached to a respective side of said seat frame means.

14. The apparatus of claim 13, wherein each of said panels is adapted to move between a vertically downwardly oriented position and a locked, substantially horizontal position.

15. An elevating convertible wheelchair, comprising:

a lower support frame means carrying a plurality of rotating wheels attached thereto;

a plurality to telescoping leg means fixedly anchored at their lower ends to said lower frame means and extending vertically therefrom;

a seat frame means carried by upper ends of the leg means;

a backrest means hingedly attached to the seat frame means and movable from a first, normally vertically oriented position in perpendicular relationship to the seat frame means and a second position, substantially co-planar with said seat frame means;

a secondary backrest support means hingedly attached to a free end of said backrest means and movable between a normally co-planar position with said backrest means to a position substantially perpendicular to said backrest means, so as to support a free end of the backrest means when the wheelchair is converted to a flat bed;

a release means for releasing a locked position of the backrest means and allowing rotation of the backrest means into the second position;

a means for elevating the seat frame means to a desired level, said elevating means being carried by the lower frame means;

a detachable arm rest removably engageable with at least one of said leg means; and a connecting panel means secured to at least one side of the wheelchair for covering a space between the converted flat bed and an adjacent side of a regular patient bed.

16. The apparatus of claim 15, wherein said arm rest means comprises a pair of arcuate handles, each having a forward end and a distant end, and wherein said forward end is telescopically detachably engaged with at least one of said leg means.

17. The apparatus of claim 16, wherein said seat frame means comprises a pair of elongated parallel tubular rail members, and wherein each of said tubular rail members is provided with an opening which receives the distant end of one of the handles therethrough.

18. The apparatus of claim 15, wherein said elevating means comprises a foot pedal for activating said elevating means.

19. The apparatus of claim 15, wherein each of said leg means comprises a lower portion which engages the lower frame means and an upper portion which is telescopically received in the lower portion.

20. The apparatus of claim 19, wherein each of said leg means is provided with a means for limiting telescopical movement, said means comprising a transverse pin which is secured to the upper leg portion in transverse relationship to a longitudinal axis of the upper leg portion.

21. The apparatus of claim 15, further comprising detachable headrest means adapted to be engaged with the backrest means.

22. The apparatus of claim 21, wherein said backrest means comprises an upper cross bar attached at its ends to a pair of parallel elongated tubular rail members, and wherein said headrest means comprises a pair of elongated rod members, a portion of each of which is telescopically retractably received in a corresponding rail member of the backrest means.

23. The apparatus of claim 22, wherein said headrest means further comprises a headrest panel stretched between the elongated rod members and a transverse bar.

24. The apparatus of claim 15, wherein said connecting panel means comprises a panel and a pair of engagement legs perpendicularly attached to an underside of the panel.

25. The apparatus of claim 24, wherein said seat frame means comprises a pair of parallel elongated rail members, and said backrest frame means comprises a pari of elongated parallel frame tubes, and wherein openings are formed in said rail members an said frame tubes, said openings being sized and shaped to receive free ends of the panel engagement legs therein.

26. The apparatus of claim 15, wherein said connecting panel means comprises a pair of panels, each of which is hingedly attached to a respective side of said seat frame means.

27. The apparatus of claim 26, wherein each of said panels is adapted to move between a vertically downwardly oriented position and a locked, substantially horizontal position.

28. An elevating convertible wheelchair, comprising:

a lower support frame means carrying a plurality of rotating wheels attached thereto;

a plurality of telescoping leg means fixedly anchored at their lower ends to the lower support frame means and extending vertically therefrom;

a seat frame means carried by upper ends of the leg means;

a backrest means hingedly attached to the seat frame means and moveable from a first, normally vertically oriented position in perpendicular relationship to the seat frame means to a second position, substantially co-planar with said frame means;

a secondary backrest support means hingedly attached to a free end of said backrest means and moveable between a normally co-planar position with said backrest means to a position substantially perpendicular to said backrest means, so as to support the free end of the backrest means when the wheelchair is converted to a flat bed;

a means for elevating the seat frame means to a desired level, said elevating means being carried by the lower frame means; and a detachable headrest means removably engageable with the backrest means in a substantially co-planar relationship thereto, wherein said backrest means comprises an upper cross bar attached at its ends to a pair of parallel elongated tubular rail members, and wherein said headrest means comprises a pair of elongated rod members, a portion of each of which is telescopically retractably received in a corresponding rail member of the backrest means.

* * * * *